US007121678B1

(12) United States Patent
Shetter

(10) Patent No.: US 7,121,678 B1
(45) Date of Patent: Oct. 17, 2006

(54) PORTABLE EMERGENCY LIGHT

(76) Inventor: Edwin E. Shetter, 5302 Arrow Ave., Anniston, AL (US) 36203

( * ) Notice: Subject to any disclaimer, the term of this patent is extended or adjusted under 35 U.S.C. 154(b) by 0 days.

(21) Appl. No.: 11/166,928

(22) Filed: Jun. 27, 2005

(51) Int. Cl.
*F21L 4/02* (2006.01)

(52) U.S. Cl. ..... 362/184; 362/227; 362/240; 362/410; 362/800

(58) Field of Classification Search ..... 362/249, 362/227, 251, 184, 190, 296, 307, 240, 347, 362/410, 395, 800
See application file for complete search history.

(56) References Cited

U.S. PATENT DOCUMENTS 3,944,806 A 3/1976 Jones et al.
5,105,347 A * 4/1992 Ruud et al. ..... 362/268
D331,198 S 11/1992 Nickerson
5,442,258 A 8/1995 Shibata
6,231,207 B1 5/2001 Kennedy et al.
6,572,249 B1 6/2003 Bailey
6,685,335 B1 2/2004 Yeh et al.
6,695,460 B1 * 2/2004 Warne ..... 362/249

* cited by examiner

*Primary Examiner*—Laura K. Tso

(57) ABSTRACT

A light includes a frusto-conical base that has a planar bottom surface including an access door conjoined thereto. A transparent body is conjoined to the base top surface that has annular upper and lower portions defining a cavity therebetween. The upper portion includes a transparent lens disposed about an axis thereof. A mechanism is included for illuminating the body and refracting light arrays away therefrom. The illuminating mechanism includes a conical mirror disposed within the cavity. The mirror is formed from transparent material and has a maximum diameter equal to approximately one-half a diameter of the body. The mirror extends medially upward from the body and terminates at a top surface of the body. A power source is electrically coupled to the illuminating mechanism.

18 Claims, 5 Drawing Sheets

PORTABLE EMERGENCY LIGHT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to emergency lights and, more particularly, to a portable emergency light for providing illumination during emergency situations and electrical outages.

2. Prior Art

It has been found that incandescent lamps and fluorescent lamps are generally used for camping. However, such lamps require a lot of electric power for operation, thereby making it necessary for the user to carry a large amount of batteries and therefore causing much inconvenience in use. Hence, a lamp with light emitting diodes (LED's) has been proposed to mitigate this drawback.

In the field of hand-held light sources which utilize LED's, there are many devices with various applications including flashlights, signal sticks and lighted wands. Some devices provide omni-directional lighting for illuminating a region around the device in a fashion similar to a lamp. Unfortunately, the quality of light and extent of illumination provided by these devices is not adequate for functional employment thereof. This is especially true for emergency and camping applications of such devices, where quality and extent of illumination almost becomes vital to survival.

Accordingly, a need remains for a portable emergency light in order to overcome the above-noted shortcomings. The present invention satisfies such a need by providing a portable emergency light that is easy to use, versatile in its methods of use, is attractive and cost-effective in design, light weight, provides superior lighting, and is portable. Such a portable emergency light provides efficient lighting for one or two rooms in a house. The decorative design thereof allows the light to be displayed on a table, or to be suspended from the roof in the same fashion as a chandelier. Such a battery operated emergency light is ideal for emergency situations, like power outages, where it provides a quick, convenient, and readily available light source. The portable emergency light can be produced in a variety of different styles, shapes, colors and designs in order to enhance any decor. Such a portable light is also ideal for providing light during outdoor activities like camping, fishing, hiking etc., due to its light weight, yet durable design.

BRIEF SUMMARY OF THE INVENTION

In view of the foregoing background, it is therefore an object of the present invention to provide a portable emergency light. These and other objects, features, and advantages of the invention are provided by a portable light for providing illumination during emergency situations and electrical outages.

The light includes a base member that has a substantially planar bottom surface including a medially disposed access door directly conjoined thereto. Such a base member has a frusto-conical shape. A transparent body is directly conjoined to a top surface of the base member. Such a body has annular upper and lower portions defining a cavity therebetween. The lower portion has a circumference equal to a circumference of the upper portion. Such an upper portion includes a transparent lens centrally disposed about a vertical axis thereof.

A mechanism is included for illuminating the body and refracting light arrays away from the body such that the light arrays effectively form an oblique angle offset from the circumference of the upper portion. Such an illuminating mechanism includes a conical mirror centrally disposed within the cavity. The conical mirror is formed from transparent material and has a maximum diameter equal to approximately one-half a diameter of the body. Such a conical mirror extends upwardly from a medial region of the body and terminates at a top surface of the body. The conical mirror preferably extends downwardly from an upper portion of the body. Such a mirror is disposed centrally of the body and has an apex and a base disposed proximate and distal to the other light emitting sources. A power source is electrically coupled to the illuminating mechanism.

Such an illuminating mechanism preferably includes a plurality of light emitting sources. The light emitting sources may include a plurality of LEDs. Selected ones of the light emitting sources may include first colored LEDs and other ones of the light emitting sources include second colored LEDs. Selected ones of the light emitting sources are spaced along a semi-spherical distance defined along an outer surface of the upper portion. Such selected ones of the light emitting sources effectively transmit light arrays radially outwardly from the body without passing through the conical mirror. Other ones of the light emitting sources are disposed centrally of the body and grouped in a predetermined pattern spaced from the selected light emitting sources. Such a predetermined pattern effectively defines a generally star shape. The other light emitting sources transmit light arrays upwardly and radially through the conical mirror prior to exiting the body.

The conical mirror is vertically aligned above the other light emitting sources, wherein the conical mirror diffuses and refracts the light arrays away from the body to effectively and advantageously evenly distribute light into an ambient area surrounding the body. A plurality of switches are electrically coupled to the power source and disposed medially between the bottom surface of the base member and a top surface thereof. Such switches conveniently toggle the illuminating mechanism between on and off positions. Preferably, a first one of the switches toggles selected ones of the light emitting sources spaced about the body between on and off positions, a second one of the switches toggles selected ones of the light emitting sources disposed centrally of the body between on and off positions, and a third one of the switches toggles remaining ones of the light emitting sources disposed centrally of the body between on and off positions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
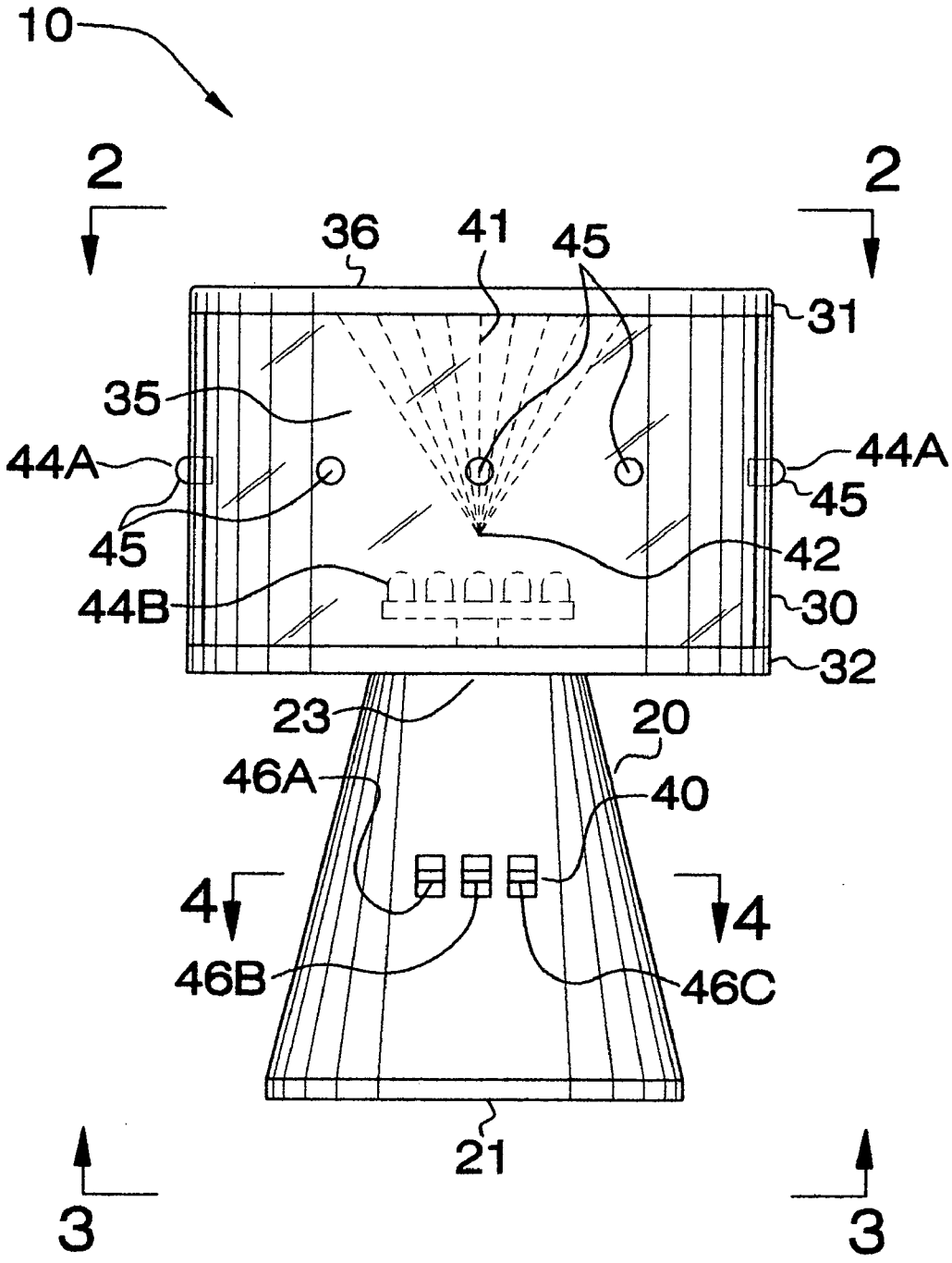
FIG. 1 is a side-elevational view showing a portable emergency light, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–6 by the reference numeral 10 and is intended to provide a portable emergency light. It should be understood that the device 10 may be used to provide light under many different types of circumstances and should not be limited in use to only being an emergency light source.

Figure 3:
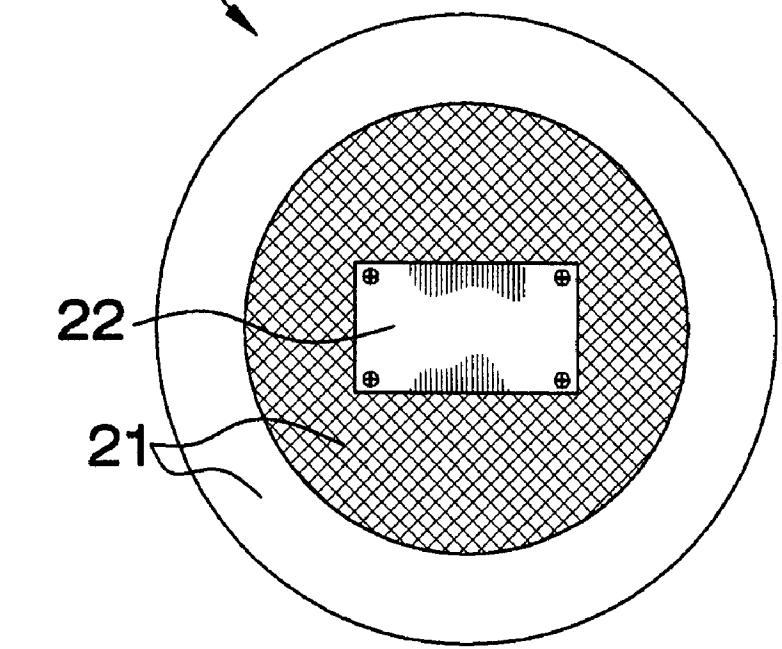
FIG. 3 is a bottom plan view of the device shown in FIG. 1, viewed along line 3—3 and showing the access door.
Figure 2:
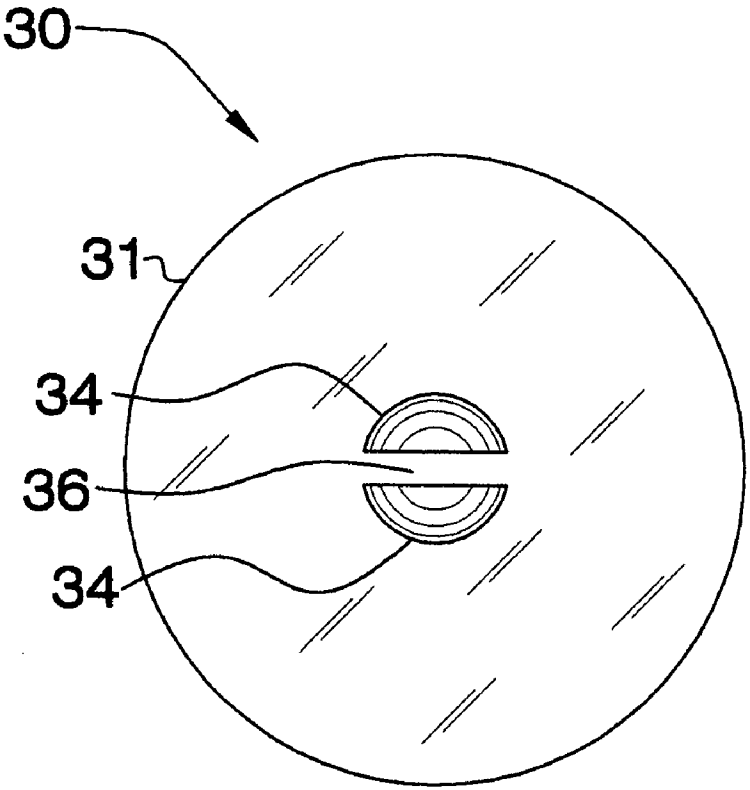
FIG. 2 is a top plan view of the device shown in FIG. 1, viewed along line 2—2.
Figure 4:
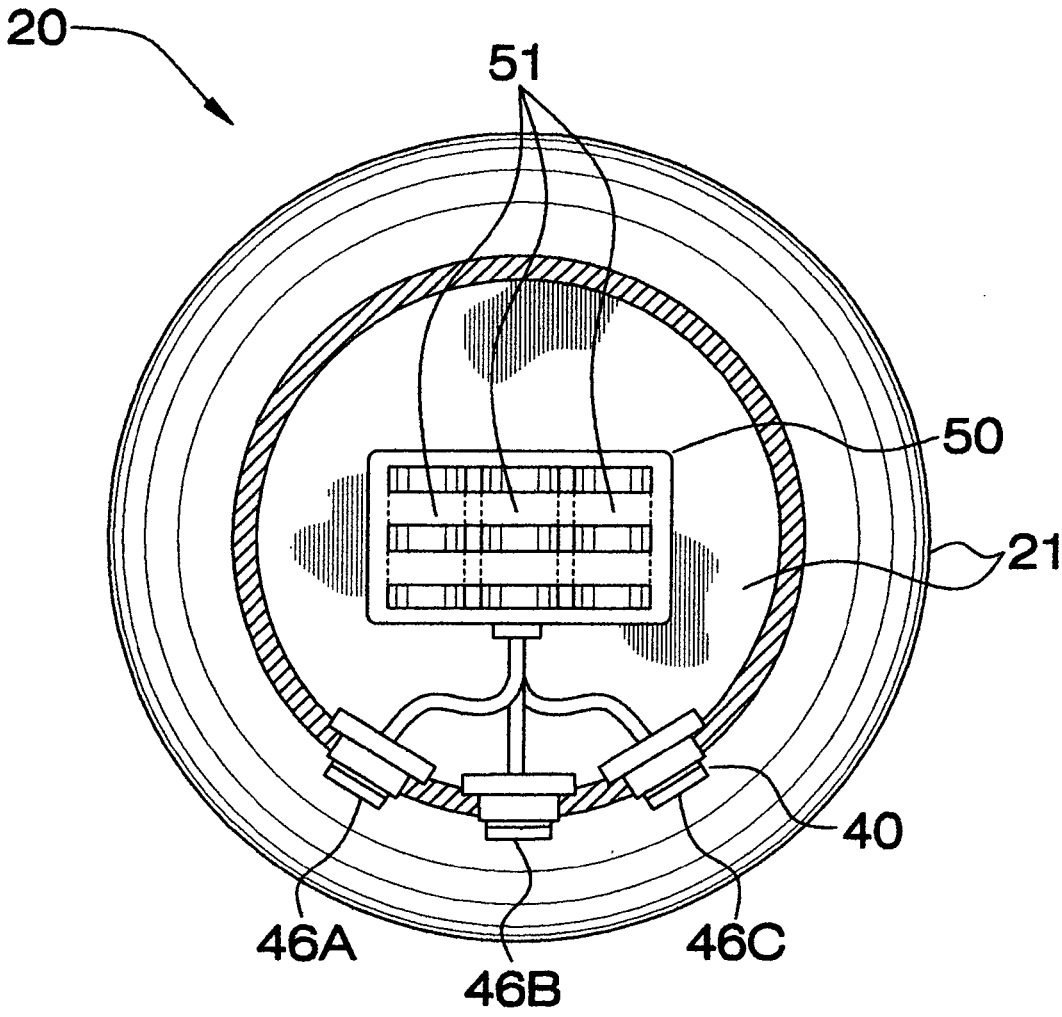
FIG. 4 is a cross-sectional view of the base member shown in FIG. 1, taken along line 4—4.

Referring initially to FIGS. 1 through 3, the device 10 includes a base member 20 that has a substantially planar and textured bottom surface 21 including a medially disposed access door 22 directly conjoined, with no intervening elements, thereto. The access door 22 is essential for providing convenient access to the power source 50 (described herein below), while the textured surface provides a frictional force to prevent slippage of the device 10. Such a base member 20 has a frusto-conical shape. A transparent body 30 is directly conjoined, with no intervening elements, to a top surface 23 of the base member 20. Such a body 30 has annular upper 31 and lower 32 portions defining a cavity 33 therebetween. The lower portion 32 has a circumference equal to a circumference of the upper portion 31. Such an upper portion 31 includes a transparent lens 34 centrally disposed about a vertical axis thereof. Of course, the base member 20 and the body 30 may be produced in a variety of alternate shapes, sizes, colors, styles and designs to enhance any decor, as is obvious to a person of ordinary skill in the art.

Referring to FIGS. 1, 4, 5 and 6, a mechanism 40 is included for effectively illuminating the body 30 and refracting light arrays away from the body 30 such that the light arrays effectively form an oblique angle offset from the circumference of the upper portion 31. Such an illuminating mechanism 40 includes a conical mirror 41 centrally disposed within the cavity 33. The conical mirror 41 is formed from transparent material and has a maximum diameter equal to approximately one-half a diameter of the body.

The transparent nature of the conical mirror 41 is important and convenient for allowing light to pass therethrough. Such a conical mirror 41 extends upwardly from a medial region 35 of the body 30 and terminates at a top surface 36 of the body 30. The conical mirror 41 further extends downwardly from an upper portion 31 of the body 30. Such a mirror 41 is disposed centrally of the body 30 and has an apex 42 and a base (not shown) disposed proximate and distal to the other light emitting sources 44B (described herein below), respectively. Such a positioning of the conical mirror 41 is crucial for effectively allowing light passing therethrough to be outwardly refracted, which in turn results in the formation of an annular ring of light emitted through the conical mirror 41.

A power source 50 is electrically coupled to the illuminating mechanism 40. The power source 50 includes a plurality of batteries 51, wherein three C-cell batteries 51 are used. Of course, the power source 50 may use an alternate number and type of batteries 51, as is obvious to a person of ordinary skill in the art.

Figure 5:
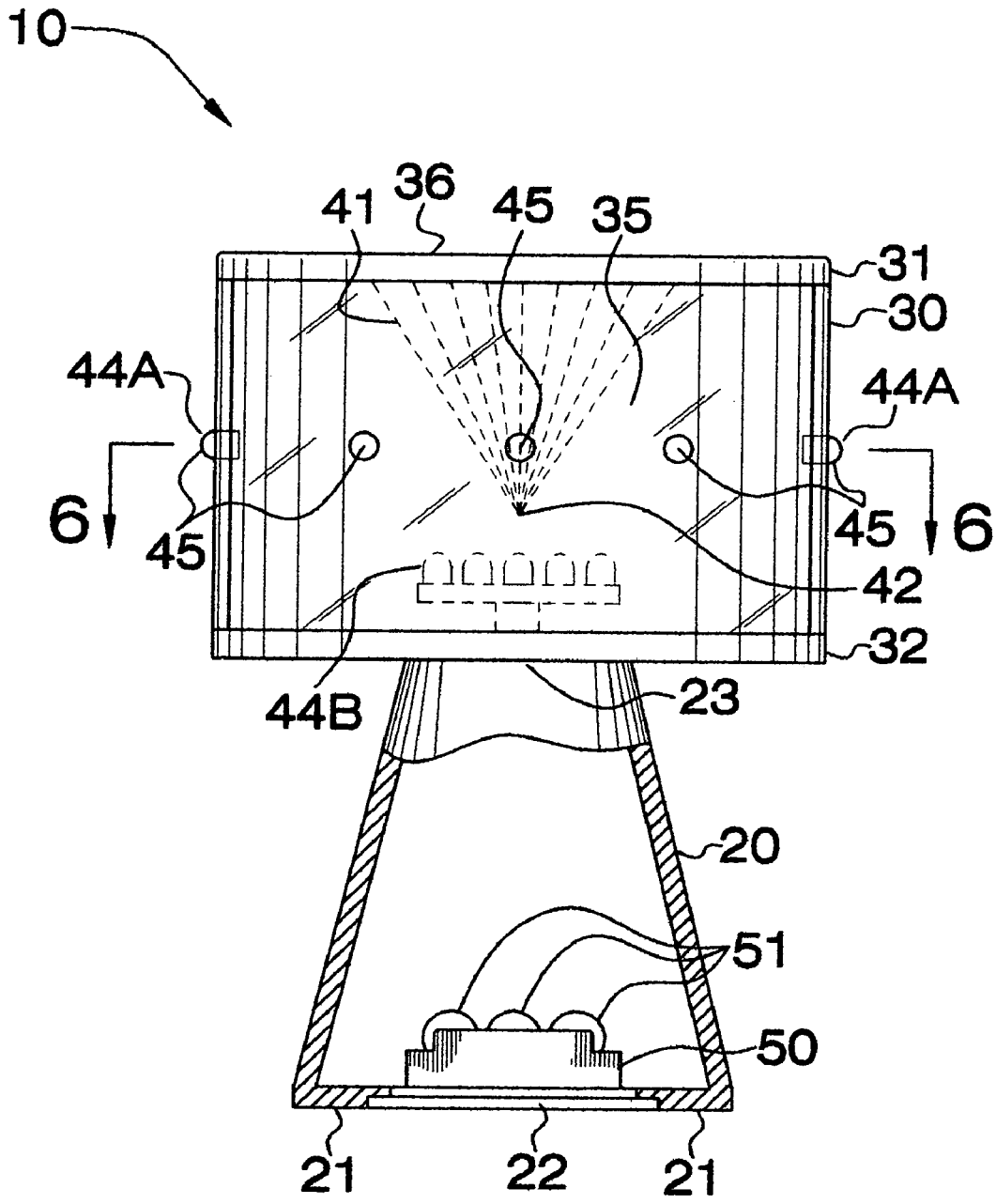
FIG. 5 is a partially exposed side-elevational view of the device shown in FIG. 1, showing the power source.
Figure 6:
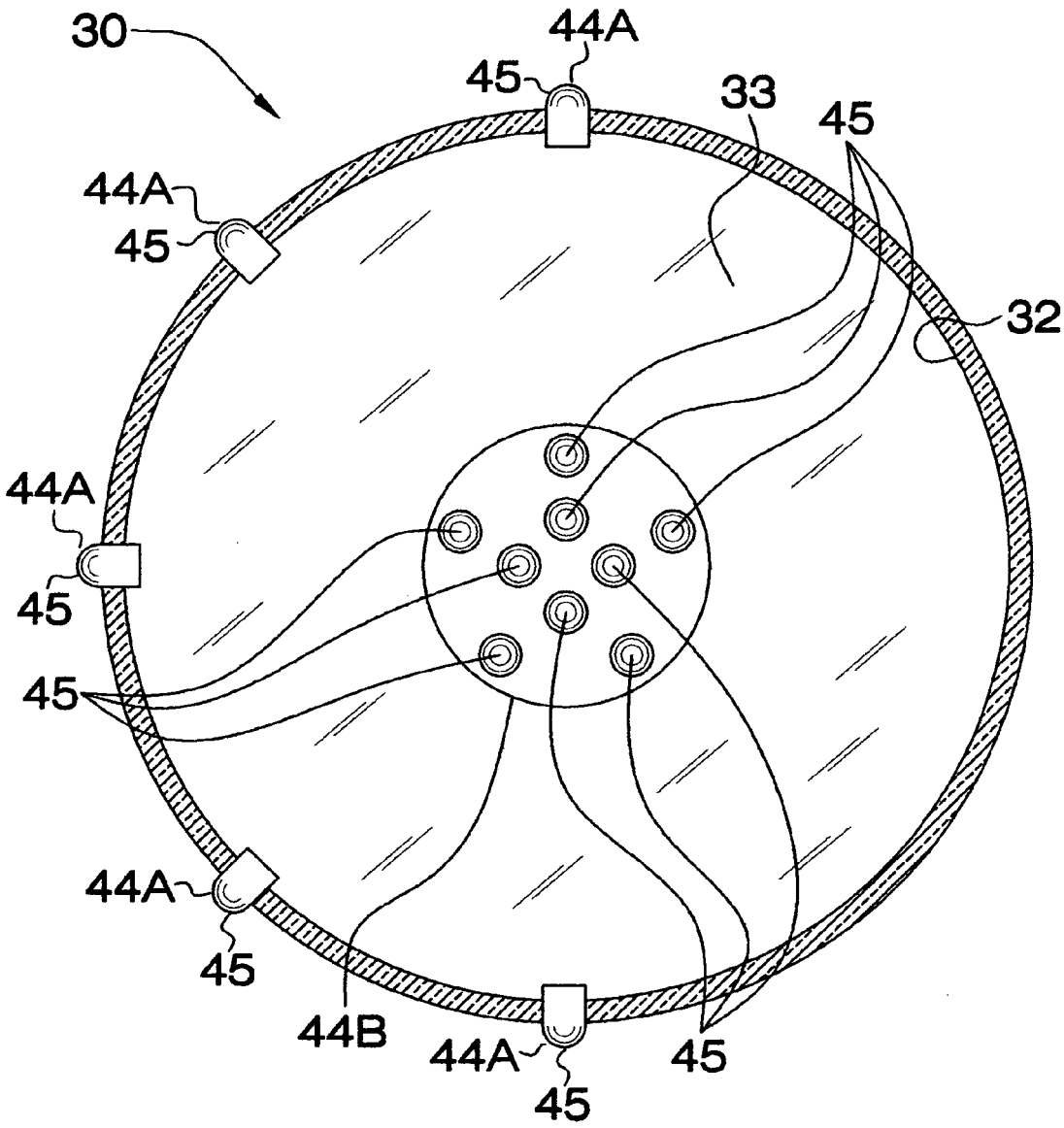
FIG. 6 is a cross-sectional view of the body shown in FIG. 5, taken along line 6—6 and showing the star shaped pattern of the LEDs.

Referring to FIGS. 1, 5 and 6, such an illuminating mechanism 40 includes a plurality of light emitting sources 44. The light emitting sources include a plurality of LEDs 45 that advantageously require less power to be lit than conventional incandescent light bulbs, thus allowing the device 10 to operate for longer periods of time on the power source 50 than devices with incandescent bulbs would and at a lower cost. Selected ones 44A of the light emitting sources 44 include first colored LEDs and other ones 44B of the light emitting sources 44 include second colored LEDs. Of course, the LEDs 45 may have a uniform color or may include more than two colors, as is obvious to a person of ordinary skill in the art.

Selected ones 44A of the light emitting sources 44 are spaced along a semi-spherical distance defined along an outer surface 37 of the upper portion 31. Of course, the selected light emitting sources 44A may be alternately positioned, as is obvious to a person of ordinary skill in the art. Such selected ones 44A of the light emitting sources 44 effectively transmit light arrays radially outwardly from the body 30 without passing through the conical mirror 41. Other ones 44B of the light emitting sources 44 are disposed centrally of the body 30 and grouped in a predetermined pattern spaced from the selected light emitting sources 44A. Such a predetermined pattern effectively defines a generally star shape, as is best illustrated in FIG. 6. Of course, the other light emitting sources 44B may be positioned in an alternate predetermined shape, such as triangular or circular, as is obvious to a person of ordinary skill in the art. The other light emitting sources 44B effectively transmit light arrays upwardly and radially through the conical mirror 41 prior to exiting the body 30.

Referring to FIGS. 1 and 5, the conical mirror 41 is vertically aligned above the other light emitting sources 44B, which is vital so that the conical mirror 41 diffuses and refracts the light arrays away from the body 30 to effectively and advantageously evenly distribute light into an ambient area surrounding the body 30. A plurality of switches 46 are electrically coupled to the power source 50 and disposed medially between the bottom surface 21 of the base member 20 and a top surface 23 thereof. Such switches 46 are crucial for conveniently toggling the illuminating mechanism 40 between on and off positions.

A first one 46A of the switches 46 toggles selected ones 44A of the light emitting sources 44 spaced about the body 30 between on and off positions and a second one 46B of the switches 46 toggles selected ones 44B of the light emitting sources 44 disposed centrally of the body 30 between on and off positions. A third one 46C of the switches 46 toggles remaining ones 44B of the light emitting sources 44 disposed centrally of the body 30 between on and off positions. Such switches 46 conveniently allow a user to selectively activate the various groups of LEDs 45 depending on their lighting needs. Such selective lighting also helps to conserve the power source 50 since less power is used to light only one group of LED's 45.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable light for providing illumination during emergency situations and electrical outages, said light comprising:

a base member having a substantially planar bottom surface including a medially disposed access door directly conjoined thereto, said base member having a frusto-conical shape;

a transparent body directly conjoined to a top surface of said base member, said body having annular upper and lower portions defining a cavity therebetween, said lower portion having a circumference equal to a circumference of said upper portion, said upper portion including a transparent lens centrally disposed about a vertical axis thereof;

means for illuminating said body and refracting light arrays away from said body such that the light arrays form an oblique angle offset from the circumference of said upper portion, said illuminating means comprising: a conical mirror centrally disposed within the cavity; and a power source electrically coupled to said illuminating means.

2. The light of claim 1, wherein said illuminating means comprises:

a plurality of light emitting sources, selected ones of said light emitting sources being spaced along a semi-spherical distance defined along an outer surface of said upper portion, other ones of said light emitting sources being disposed centrally of said body and grouped in a predetermined pattern spaced from said selected light emitting sources, said predetermined pattern defining a generally star shape, said conical mirror being vertically aligned above said other light emitting sources; and a plurality of switches electrically coupled to said power source and disposed medially between said bottom surface of said base member and a top surface thereof, said switches for toggling said illuminating means between on and off positions;

wherein said selected ones of said light emitting sources transmit light arrays radially outwardly from said body without passing through said conical mirror, said other light emitting sources transmit light arrays upwardly and radially through said conical mirror prior to exiting said body;

wherein said conical mirror diffuses and refracts the light arrays away from said body to evenly distribute light into an ambient area surrounding said body.

3. The light of claim 1, wherein a first one of said switches toggles selected ones of said light emitting sources spaced about said body between on and off positions, a second one of said switches toggles selected ones of said light emitting sources disposed centrally of said body between on and off positions, a third one of said switches toggles remaining ones of said light emitting sources disposed centrally of said body between on and off positions.

4. The light of claim 2, wherein said light emitting sources comprise: a plurality of LEDs.

5. The light of claim 2, wherein said conical mirror extends downwardly from an upper portion of said body, said mirror being disposed centrally of said body and having an apex and a base disposed proximate and distal to said other light emitting sources.

6. The light of claim of claim 1, wherein selected ones of said light emitting sources comprise a first colored LEDs and other ones of said light emitting sources comprise a second colored LEDs.

7. A portable light for providing illumination during emergency situations and electrical outages, said light comprising:

a base member having a substantially planar bottom surface including a medially disposed access door directly conjoined thereto, said base member having a frusto-conical shape;

a transparent body directly conjoined to a top surface of said base member, said body having annular upper and lower portions defining a cavity therebetween, said lower portion having a circumference equal to a circumference of said upper portion, said upper portion including a transparent lens centrally disposed about a vertical axis thereof;

means for illuminating said body and refracting light arrays away from said body such that the light arrays form an oblique angle offset from the circumference of said upper portion, said illuminating means comprising: a conical mirror centrally disposed within the cavity;

wherein said conical mirror is formed from transparent material and has a maximum diameter equal to approximately one-half a diameter of said body; and a power source electrically coupled to said illuminating means.

8. The light of claim 7, wherein said illuminating means comprises:

a plurality of light emitting sources, selected ones of said light emitting sources being spaced along a semi-spherical distance defined along an outer surface of said upper portion, other ones of said light emitting sources being disposed centrally of said body and grouped in a predetermined pattern spaced from said selected light emitting sources, said predetermined pattern defining a generally star shape, said conical mirror being vertically aligned above said other light emitting sources; and a plurality of switches electrically coupled to said power source and disposed medially between said bottom surface of said base member and a top surface thereof, said switches for toggling said illuminating means between on and off positions;

wherein said selected ones of said light emitting sources transmit light arrays radially outwardly from said body without passing through said conical mirror, said other light emitting sources transmit light arrays upwardly and radially through said conical mirror prior to exiting said body;

wherein said conical mirror diffuses and refracts the light arrays away from said body to evenly distribute light into an ambient area surrounding said body.

9. The light of claim 7, wherein a first one of said switches toggles selected ones of said light emitting sources spaced about said body between on and off positions, a second one of said switches toggles selected ones of said light emitting sources disposed centrally of said body between on and off positions, a third one of said switches toggles remaining ones of said light emitting sources disposed centrally of said body between on and off positions.

10. The light of claim 8, wherein said light emitting sources comprise: a plurality of LEDs.

11. The light of claim 8, wherein said conical mirror extends downwardly from an upper portion of said body, said mirror being disposed centrally of said body and having an apex and a base disposed proximate and distal to said other light emitting sources.

12. The light of claim of claim 7, wherein selected ones of said light emitting sources comprise a first colored LEDs and other ones of said light emitting sources comprise a second colored LEDs.

13. A portable light for providing illumination during emergency situations and electrical outages, said light comprising:

a base member having a substantially planar bottom surface including a medially disposed access door directly conjoined thereto, said base member having a frusto-conical shape;

a transparent body directly conjoined to a top surface of said base member, said body having annular upper and lower portions defining a cavity therebetween, said lower portion having a circumference equal to a circumference of said upper portion, said upper portion including a transparent lens centrally disposed about a vertical axis thereof;

means for illuminating said body and refracting light arrays away from said body such that the light arrays form an oblique angle offset from the circumference of said upper portion, said illuminating means comprising: a conical mirror centrally disposed within the cavity;

wherein said conical mirror is formed from transparent material and has a maximum diameter equal to approximately one-half a diameter of said body;

wherein said conical mirror extends upwardly from a medial region of said body and terminates at a top surface of said body; and a power source electrically coupled to said illuminating means.

14. The light of claim 13, wherein said illuminating means comprises:

a plurality of light emitting sources, selected ones of said light emitting sources being spaced along a semi-spherical distance defined along an outer surface of said upper portion, other ones of said light emitting sources being disposed centrally of said body and grouped in a predetermined pattern spaced from said selected light emitting sources, said predetermined pattern defining a generally star shape, said conical mirror being vertically aligned above said other light emitting sources; and a plurality of switches electrically coupled to said power source and disposed medially between said bottom surface of said base member and a top surface thereof, said switches for toggling said illuminating means between on and off positions;

wherein said selected ones of said light emitting sources transmit light arrays radially outwardly from said body without passing through said conical mirror, said other light emitting sources transmit light arrays upwardly and radially through said conical mirror prior to exiting said body;

wherein said conical mirror diffuses and refracts the light arrays away from said body to evenly distribute light into an ambient area surrounding said body.

15. The light of claim 13, wherein a first one of said switches toggles selected ones of said light emitting sources spaced about said body between on and off positions, a second one of said switches toggles selected ones of said light emitting sources disposed centrally of said body between on and off positions, a third one of said switches toggles remaining ones of said light emitting sources disposed centrally of said body between on and off positions.

16. The light of claim 14, wherein said light emitting sources comprise: a plurality of LEDs.

17. The light of claim 14, wherein said conical mirror extends downwardly from an upper portion of said body, said mirror being disposed centrally of said body and having an apex and a base disposed proximate and distal to said other light emitting sources.

18. The light of claim of claim 13, wherein selected ones of said light emitting sources comprise a first colored LEDs and other ones of said light emitting sources comprise a second colored LEDs.

* * * * *